US005086689A

United States Patent [19]

Masuda

[11] Patent Number: 5,086,689

[45] Date of Patent: Feb. 11, 1992

[54] AXIAL PISTON MACHINE

[75] Inventor: Kenji Masuda, Settsu, Japan

[73] Assignee: Daikin Industries Ltd., Osaka, Japan

[21] Appl. No.: 651,974

[22] Filed: Feb. 7, 1991

[30] Foreign Application Priority Data

Feb. 15, 1990 [JP] Japan ..... 2-34990

[51] Int. Cl.[5] ..... F01B 31/04

[52] U.S. Cl. ..... 91/499; 417/269

[58] Field of Search ..... 91/499, 484; 417/269

[56] References Cited

U.S. PATENT DOCUMENTS

| | | | |
|---|---|---|---|
| 2,445,281 | 7/1948 | Rystrom | 91/499 |
| 3,154,983 | 11/1964 | Firth | 91/499 |
| 4,201,117 | 5/1980 | Gherner | 91/499 |
| 4,223,594 | 9/1980 | Gherner | 91/499 |

*Primary Examiner*—Richard A. Bertsch
*Assistant Examiner*—Peter Korytnyk
*Attorney, Agent, or Firm*—Stevens, Davis, Miller & Mosher

[57] ABSTRACT

An axial piston machine which has an even number of piston cylinder chambers housing therein pistons in relation of being movable in reciprocation respectively so as to control a stroke of the piston by a swash plate, wherein first and second compensating pistons opposite to the swash plate are provided at the symmetrical positions with respect thereto in the vicinity of the upper dead and lower dead points inclusive, so that, when one piston cylinder chamber is positioned in the vicinity of the upper or lower dead point, control pressure at the pressurized side is introduced to the second compensating piston at the lower dead point side, or that at the pressure-reduction side to the first compensating piston at the upper dead point side, thereby reducing an exciting force caused by an abrupt pressure change in the piston cylinder chamber and a large variation in the inclined moment of the swash plate, so as to enable reduction in generation of vibrations and noises.

6 Claims, 4 Drawing Sheets

AXIAL PISTON MACHINE

FIELD OF THE INVENTION

The present invention relates to an axial piston machine, and more particularly to an axial piston machine which is provided with a cylinder block which houses pistons in a plurality of piston cylinder chambers in relation of being movable in reciprocation so that the cylinder block rotates to move the pistons in reciprocation so as to pressurize fluid taken into the piston cylinder chamber and discharge it therefrom and which is suitable particularly to a displacement pumps for performing variable discharge.

BACKGROUND OF THE INVENTION

Conventionally, this kind of axial piston machine is so constructed that a driving shaft is supported to a pump housing, a cylinder block provided with a plurality of pistons integrally rotatably coupled with the driving shaft, a valve member having a suction port and a discharge port is interposed between the cylinder block and the housing, a swash plate for controlling a stroke of each piston is disposed opposite to the respective pistons, and the cylinder block rotates following the driving shaft so as to move each piston at the stroke controlled by the swash plate, thereby continuously performing suction and discharge of the the fluid.

In detail, the piston cylinder chambers housing therein the pistons respectively are disposed circumferentially of the cylinder block at regular intervals and revolve along a fixed moving path following the rotation of cylinder block, and the suction port and discharge port are provided within the moving path, so that, when each piston cylinder chamber transfers from the upper dead point to the lower dead point with respect to the swash plate, the piston retracts into the piston cylinder chamber to take in the fluid through the suction port and, when the same transfers from the lower dead point to the upper dead point, the piston advances in the piston cylinder chamber so as to discharge the fluid therefrom through the discharge port.

Accordingly, when the piston cylinder chamber transfers from the suction port to the discharge port, in other words, when the same transfers to the discharge stroke from the suction port via the lower dead point so as to communicate with the discharge port, internal pressure in the piston cylinder chamber abruptly changes from low to high and also, when the same transfers from the discharge port to the suction port, in other words, when the same transfers from the dischage port to the suction stroke via the upper dead point so as to communicate with the suction port, the internal pressure in the piston abruptly changes from high to low.

In detail, in the vicinity of the lower dead point inclusive where the piston cylinder chamber transfers from the suction port to the discharge port at the valve member following the rotation of cylinder block and in the vicinity of the upper dead point inclusive where the same transfers from the discharge port to the suction port, abrupt pressure changes occur in the piston cylinder chambers and provide an exciting force to the whole pump system to thereby produce a cause of a large variation in the inclined moment at the swash plate, in particular. Therefore, as shown by the dotted line Y in the FIG. 4 graph to be discussed below, a large exciting force is generated at the swash plate to thereby generate vibrations and noises.

In other words, when one piston cylinder chamber transfers from the suction port to the discharge port, pressure in the piston cylinder chamber abruptly rises due to communication thereof with the discharge port, so that the piston housed in the piston cylinder chamber abruptly biases the swash plate. When another piston cylinder chamber transfers from the discharge port to the suction port, pressure in the piston cylinder chamber abruptly lowers due to communication thereof with the suction port, so that a biasing force of the piston to the swash plate is immediately decreased.

On the other hand, in a case where an even number of piston cylinder chambers are formed, when one piston cylinder chamber communicates with the discharge port in the vicinity of the lower dead point and abruptly raises its internal pressure, another piston cylinder chamber communicates with the suction port in the vicinity of the upper dead point to result in that its internal pressure abruptly lowers, whereby a biasing operation of the piston housed in the piston cylinder chamber is inverted with respect to the swash plate. As a result, the swash plate vibrates because of variation in the inclined moment thereof, thereby generating noises.

The conventional method has been proposed, in which the suction port and discharge port at the valve member are provided with notches respectively to provide a reduced rate of change in pressure in the piston cylinder chamber and reduce the exciting force to the swash plate. Such method, however, is limited in reduction of pressure, and when the pressure at the load side, a flow rate of discharged fluid, and the number of rotations of cylinder block vary, the characteristic also changes so as not to sufficiently reduce the exciting force, resulting in that vibrations and noises are yet generated.

SUMMARY OF THE INVENTION

An object of the present invention is to provide an axial piston machine which is effective in reducing the exciting force so as to effectively restrain generation of vibrations and noises.

In detail, the present invention is directed to an improvement in an axial piston machine provided with a housing, a cylinder block rotatably supported to the housing and provided with an even number of piston cylinder chambers concentrically disposed with respect to the axis of rotation and an even number of pistons reciprocally movably housed in the piston cylinder chambers respectively, a driving shaft for driving the cylinder block, a swash plate for controlling a stroke in reciprocation of each piston, and a valve member having the suction port and a discharge port communicating with each piston cylinder chamber, the improvement comprising; (a) first and second compensating pistons which are located opposite to the swash plate and are disposed on the housing at the positions radially outward of the cylinder block and at the symmetrical positions in the vicinity of the upper dead point inclusive where each piston cylinder chamber transfers from the discharge port to the suction port and in the vicinity of the lower dead point inclusive where the same transfers from the suction port to the discharge port; and (b) control means for introducing control pressure to the first compensating pistons, which includes a first control pressure passage connected to the rear side of the first compensating piston and a second pressure passage connected to the rear side of the second compensating piston, so that, when each piston cylinder chamber is positioned in the vicinity of the upper dead point, control pressure at the pressurized side is introduced to the second compensating piston through the second control pressure passage and, when the same is positioned in the vicinity of the lower dead point, control pressure at the pressure-reduction side is introduced to the first compensating piston through the first control pressure passage.

The present invention is characterized in that the axial piston machine using an even number of piston cylinder chambers to control by the swash plate the stroke of the piston housed in each piston cylinder chamber in relation of being movable in reciprocation to discharge through the discharge port a fluid taken-in the suction port, the first and second compensating pistons are disposed on the housing portion symmetrically to each other in the vicinities of the upper and lower points and control pressure is introduced to the compensating pistons, thereby compensating variation in the inclined moment of the swash plate caused by the pressure in each piston cylinder chamber.

Accordingly, the present invention can largely decrease the exciting force to the pump system to effectively restrain generation of vibrations and noises.

In greater detail, when the piston cylinder chamber is positioned in the vicinity of the upper dead point where the same is about to transfer from the discharge port to the suction port at the valve member following the rotation of cylinder block, the pressure control means controls the control pressure acting on the first compensating piston, and when the piston cylinder chamber is positioned in the vicinity of the lower dead point where the same is about to transfer from the suction point to the discharge point at the high pressure side, the pressure control member controls the control pressure acting on the second compensating piston from low to high. Thus, the control pressure acting on the first and second compensating pistons is controlled, whereby a large variation in the inclined moment of swash plate caused by pressure change in the piston cylinder chamber communicating with the suction port or the discharge port can be reduced. Accordingly, even though internal pressure in each piston cylinder chamber abruptly varies when it transfers from the suction port to the discharge port and vice versa, and the pressure change is generated simultaneously at both the upper and lower dead points so as to slantwise move the swash plate, the first and second compensating pistons bias the swash plate so that the biasing force compensates the swash plate not to slantwise move whereby there is no fear that a large variation in the inclined moment is generated. Hence, an apparent exciting force with respect to the swash plate or the pump system is reduced and generation of noises is restrained.

The present invention is further characterized in that pressure in the piston cylinder chambers positioned in the vicinities of the upper and lower dead points is utilized to be crosswise introduced to the first and second compensating pistons.

In other words, on the moving path of each piston cylinder chamber, at an intermediate portion between the discharge port and the suction port, and in the vicinity of the upper dead point on the valve member, a first compensating port communicating with the piston cylinder chamber is provided, and similarly, in the vicinity of the lower dead point is provided a second compensating port communicating with the same, so that the first compensating port open at the upper dead point side is communicated with the second compensating piston disposed at the lower dead point side and the second compensating port open at the lower dead point side is communicated with the first compensating piston disposed at the upper dead point side through the control pressure passages respectively.

In the above-mentioned construction, the first and second compensating ports and the first and second control pressure passages for crosswise communicating the compensating ports with the first and second compensating pistons respectively, constitute the pressure control means. In such case, the high pressure in the piston cylinder chamber positioned in the vicinity of the upper dead point and low pressure in the piston cylinder chamber positioned in the vicinity of lower dead point are utilized to enable the first compensating piston to be controlled from low pressure to high pressure and second compensating piston from high pressure to low pressure. The swash plate can be biased by each compensating piston in synchronism with the transfer of piston cylinder chamber with respect to the valve chamber, whereby, even though the pressure in the cylinder chamber abruptly changes, such simple construction of the axial piston machine can effectively reduce the exciting force of the swash plate, thereby effectively restraining generation of noises.

Furthermore, instead of providing the first and second compensating ports as the pressure control means, as the above-mentioned, a directional control valve, which has changeover ports connected to the respective control pressure passages, a pressure port connected to a pressure line and tank ports connected to tank lines and reversibly changes over the changeover ports to the pressure port and tank ports respectively, and synchronizing means for synchronizing the changeover of the directional control valve with the rotation of driving shaft for driving the cylinder block, may be used as the pressure control means. In this case, for example, mechanical means using a cam mechanism may be used as the synchronizing means, or electric means provided with a rotation detector for detecting the number of rotations of the driving shaft and a control device for outputting by a signal from the rotation detector a changeover signal in synchronism with the rotation of driving shaft toward the electromotive part at the directional control valve, may be used as the same.

The above and other objects and novel features of the invention will more fully appear from the following detailed description when the same is read in connection with the accompanying drawings.

DETAILED DESCRIPTION OF THE EMBODIMENT

Next, the axial piston machine of the present invention will be described in accordance with the drawings.

Figure 1:
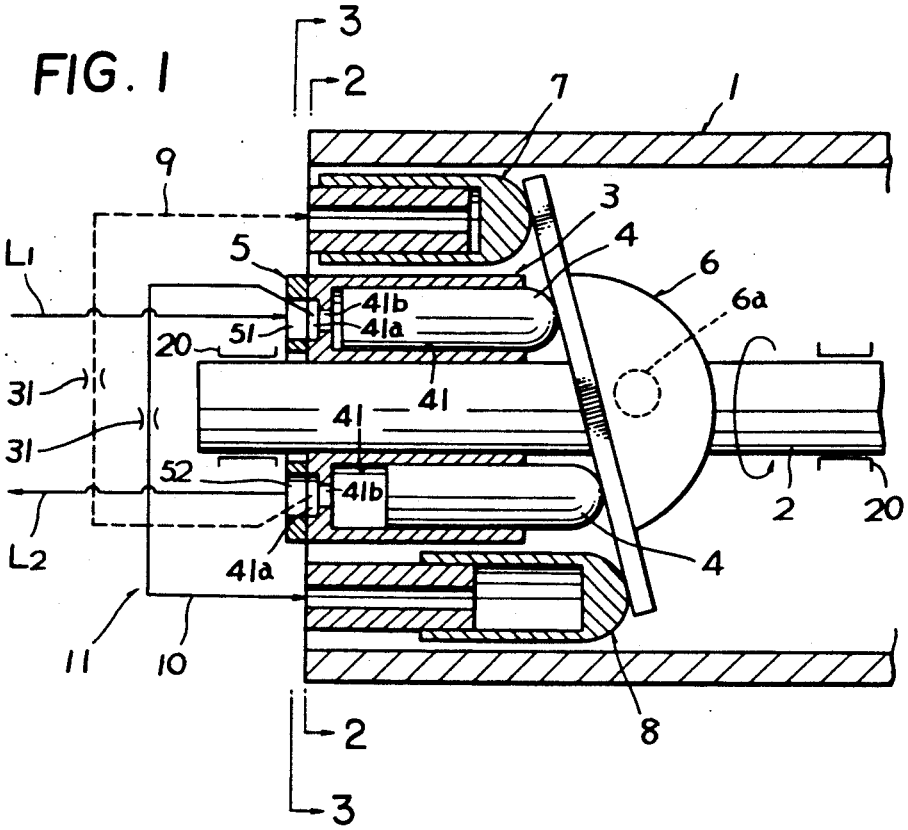
FIG. 1 is a sectional view of a principal portion of a first embodiment of an axial piston machine of the present invention.
Figure 2:
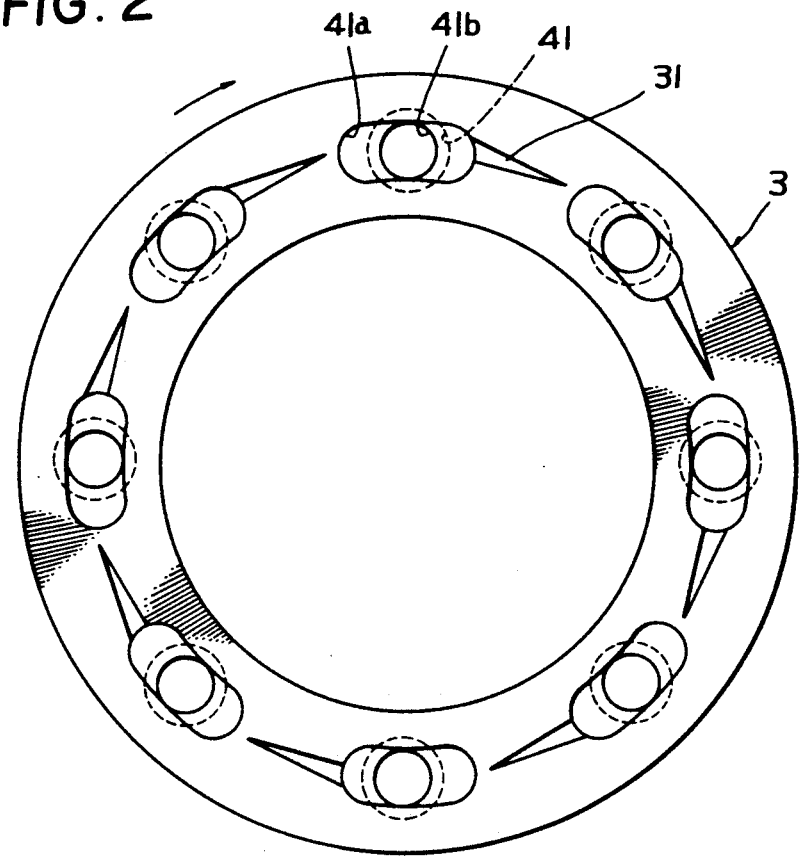
FIG. 2 is an enlarged end view of a cylinder block when viewed on the line 2—2 in FIG. 1.

FIG. 1 shows an axial piston machine of variable displacement type, in which a driving shaft 2 is rotatably supported in a pump housing 1 through a pair of bearings 20, a cylinder block 3 is spline-coupled with the driving shaft 2, eight piston cylinder chambers 41 are formed at the cylinder block 3 circumferentially thereof as shown in FIG. 2, pistons 4 are supported to the piston cylinder chambers 41 in relation of being movable in reciprocation respectively, a valve member 5 provided with a suction port 51 open at a suction line L1 and a discharge port 52 open at a discharge line L2, is disposed at the rear side of cylinder block 3 and separately from or integrally with the housing 1, and a swash plate 6 slantwise movable around a trunnion 60 is provided in the housing 1 and opposite to each piston 4, so that an inclined angle of swash plate 6 is controlled to make the stroke of each piston adjustable.

Following the rotation of cylinder block 3 by the driving shaft 2, each piston 4 is moved in reciprocation along each piston cylinder chamber 41 at the cylinder block 3 at the stroke controlled by the swash plate 6, thereby continuously performing the suction and discharge of fluid. In detail, when the cylinder block 3 shown in FIG. 2 is rotated clockwise (in the direction of the arrow in FIG. 2) with respect to a valve member 5 shown in FIG. 3, each piston transferring from the upper dead point to the lower dead point retracts rightwardly in FIG. 1 so as to take in the fluid into the piston cylinder chamber 41 from the suction port 56 and reaches the lower dead point so as to end the suction. The piston 4, when transferring from the lower dead point to the upper dead point, advances leftwardly in FIG. 1, whereby the fluid taken in the piston cylinder chamber 41 is discharged from the discharge port 52 into the discharge line L2, thus ending discharge at the upper dead point.

Generally, in the axial piston machine, pressure in each piston cylinder chamber 41 varies in the vicinity of the upper and lower dead points due to reciprocation of each piston 4 following the rotation of cylinder block 3 as the above-mentioned. Such pressure change leads to a large fluctuation in the inclined moment of swash plate 6 to thereby generate a large exciting force.

The exciting force following such moment fluctuation is decomposed into an axial component of the pump housing, a right-angled component to the axis thereof, and an inclined moment component applied to the swash plate 6. In a case where the cylinder block 3 is provided with an even number, for example, eight of pistons 4 as in this embodiment, the axial component is offset to zero at the upper and lower dead points and the right-angled component is negligible so that only the inclined moment applied to the swash plate 6 is problematical. Hence, generation of noises can be restrained by reducing the variation in inclined moment.

In order to reduce the variation in inclined moment, the axial piston machine of the present invention is constructed as follows:

At the symmetrical positions in the vicinities of the upper dead point and lower dead point of each piston 4 with respect to the swash plate 6 are disposed first and second compensating pistons 7 and 8 opposite thereto, first and second control pressure passages 9 and 10 are connected thereto respectively, and pressure control means 11 is provided which, when the piston 4 is positioned in the vicinity of the upper dead point, introduces control pressure at the pressurized side to the second compensating piston 8 at the lower dead point side through the control pressure passage 10 and which, when the same is positioned in the vicinity of the lower dead point, introduces that at the pressure-reduction side to the first compensating piston 7 at the upper dead point side through the control pressure passage 9.

In the first embodiment shown in FIGS. 1 and 2, an elliptical kidney-port 41*a* communicating with the suction port 51 or the discharge port 52 is formed at a side of each piston cylinder chamber 41 opposite to the valve member 5, the kidney-port 41*a* communicating with each piston cylinder chamber 41, and at the surface of the cylinder block 3 opposite to the valve member 5 are formed notches 31 of substantially V-like shape and extending forwardly of the rotation direction of the cylinder block 3 from the kidney-port 41*a* respectively.

Figure 3:
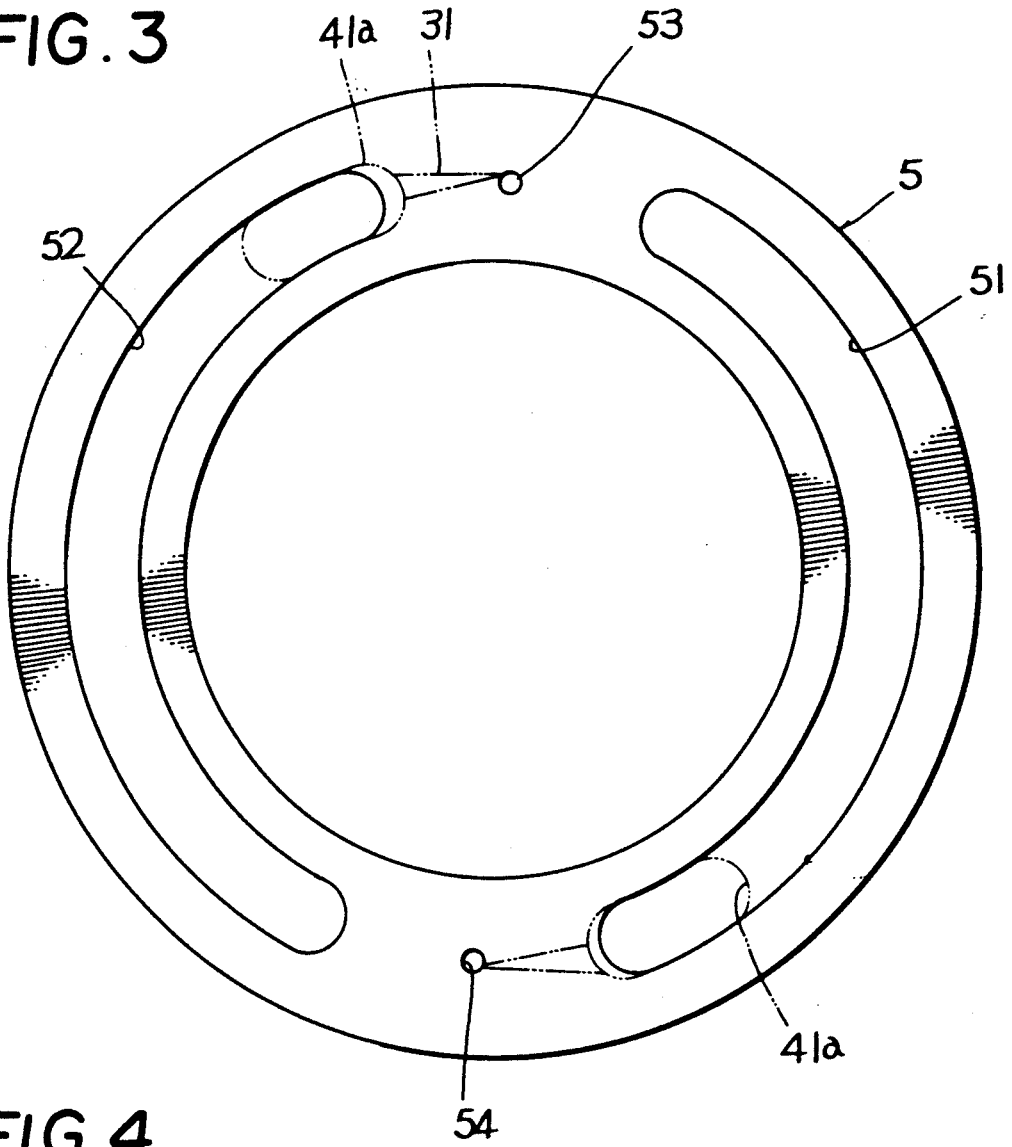
FIG. 3 is an enlarged end view of a valve member when viewed on the line 3—3 in FIG. 1.

At the valve member 5 are bilaterally symmetrically formed the suction port 51 and discharge port 52 each extending substantially in a semi-circular arc and forwardly in the rotation direction of the cylinder block 3 as shown in FIG. 3. First and second compensating ports 53 and 54, which are communicated at a certain timing with the kidney-ports 41*a* or the notches 31 respectively, are formed at intermediate portions between the suction port 51 and the valve member 5, the first compensating port 53 being communicated with the second compensating piston 8 at the lower dead point side through the second control pressure passage 10, and the second compensating port 54 being communicated with the first compensating piston 7 at the upper dead point side through the first control pressure passage 9.

In the above-mentioned construction, the pressure control means 11 comprises the first and second compensating ports 53 and 54 at the valve member 5 and the first and second control pressure passages 9 and 10, and the notches 31 form throttles resectively.

Next, explanation will be given on operation of the first embodiment constructed as the above-mentioned.

When the piston cylinder chamber 41 for each piston 4 is about to transfer from the high pressure side discharge port 52 to the low pressure side suction port 51 following the rotation of clinder block 3, as shown by the phantom line at the upper portion in FIG. 3, the notch 31 provided at the high pressure side piston cylinder chamber 41 which is about to transfer toward the suction port 51, is open at its sharp tip in advance at the first compensating port 53, so that the high pressure side piston cylinder 41 is throttled to communicate with the second compensating piston 8 at the lower dead point side through the first compensating port 53 and second control pressure passage 10, so that the high pressure fluid in the piston cylinder chamber 41 is gradually supplied toward the second compensating piston 8 through the notch 31, whereby the control pressure acting on the second compensating port 8 rises following the rotation of cylinder block 3. From this state, the piston cylinder chamber 41 passes the upper dead point and the notch 31 in advance is throttled to open at the suction port 51, whereby the control pressure of the second compensating piston 8 is gradually adjusted to low, thereby lowering the pressure in the piston cylinder chamber 41. On the other hand, when the piston cylinder chamber 41 for each piston 4 is about to transfer from the low pressure side suction port 51 to the high pressure side discharge port 52, as shown by the phantom line at the lower part in FIG. 3, the notch 31 provided at the low pressure side piston cylinder chamber 41 which is about to transfer toward the discharge port 52, is open at its sharp tip in advance at the second compensating port 54, and the low pressure side piston cylinder chamber 41 is throttled to communicate with the first compensating piston 7 at the upper dead point side through the second compensating port 54 and first control pressure passage 9, so that the control pressure of the first compensating piston 7 gradually lowers from high pressure. The piston cylinder chamber 41 passes the lower dead point and the notch 31 in advance is throttled by the discharge port 52 to be open, whereby the control pressure of first compensating piston 7 is adjusted to be gradually higher and the pressure in the piston cylinder chamber 41 gradually rises. Accordingly, when each piston 4 transfers alternately to the lower pressure side and the high pressure side, an abrupt variaton in pressure therein is generated simultaneously at the upper and lower dead points and is intended to move the swash plate 6, but, simultaneously with this, the biasing forces of first and second compensating pistons 7 and 8 compensate the swash plate 6 not to slantwise move, whereby a large variation in the inclined moment is not generated thereat and an apparent exciting force with respect to the swash plate 6 is reduced, thereby restraining generation of noises.

The above-mentioned operation is inscribed on a table shown below.

As shown in the following table, when the piston cylinder chamber 41 is about to transfer from the discharge port 52 to the suction port 51 and vice versa, the internal pressure of the piston cylinder chamber 41 just before passing the upper dead point or the lower dead point, is kept constant at high or low pressure side. In the usual axial piston machine, the internal pressure of the piston cylinder chamber 41 having passed the upper dead point is is of a descending gradient.

TABLE

| | At Upper Dead Point Piston cylinder Chamber | At Lower Dead Point Piston Cylinder Chamber | 1st Compensating Port (2nd Compensating Piston) | 2nd Compensating Port (1st Compensating Piston) |
|---|---|---|---|---|
| Before Passing Dead Point | Constant High Pressure | Constant Low Pressure | ↗ | ↘ |
| After Passing Dead | ↘ | ↗ | ↘ | ↗ |

Incidentally, the arrow in the table each show pressure change.

In the embodiment of the present invention, however, the first compensating port 53 at the upper dead point side communicates with the piston cylinder chamber through the notch 31, and the piston cylinder chamber 41 with the second compensating piston 8 at the lower dead point side through the first compensating port 53 and second pressure passage 10 before communicating with the suction port 51. As the result, the control pressure of second compensating piston 8 becomes high. Accordingly, when the piston cylinder chamber 41 communicates with the suction port 51 through the notch 31, high pressure is emitted from the second compensating piston 8 and the control pressure acting on thereon is controlled to be gardually lower and pressure of piston cylinder chamber 41 gradually lowers.

On the other hand, the piston cylinder chamber 41, the suction port 51 to the discharge port 52, is of ascending gradient after passing the lower dead point, at which time the second compensating port 54 at the lower dead point side communicates with the piston cylinder chamber 41 through the notch 31 and the piston cylinder chamber 41 communicates with the first compensating piston 7 at the upper dead point side through the second compensating port 54 and first control pressure passage 9 before communicating with the discharge port 52.

As the result, the control pressure of the first compensating piston 7 becomes lower and, when the piston cylinder chamber 41 communicates with the discharge port 52 through the notch 31, high pressure fluid flows into the first compensating piston 7, resulting in that the control pressure acting thereon is controlled to be gradually high and the pressure of the piston cylinder chamber 41 gradually rises. As the above-mentioned, when the piston cylinder chamber 41 transfers from the discharge port 52 to the suction port 51, the control pressure at the pressurized side of piston cylinder chamber 41 in the vicinity of the lower dead point where the pressure rises, is adapted to be introduced to the first compensating piston 7 at the upper dead point side, and simultaneously, when the same transfers from the suction port 51 to the discharge port 52, the control pressure at the pressure-reduction side of the piston cylinder chamber 41 in the vicinity of the upper dead point where the pressure lowers, is introduced to the second compensating piston 8 at the lower dead point side, thereby effectively restraining generation of a large variation in the inclined moment at the swash plate 6. Hence, the exciting force thereof is largely reducible in comparison with the conventional example (by about one fourth) as shown in FIG. 4.

Figure 4:
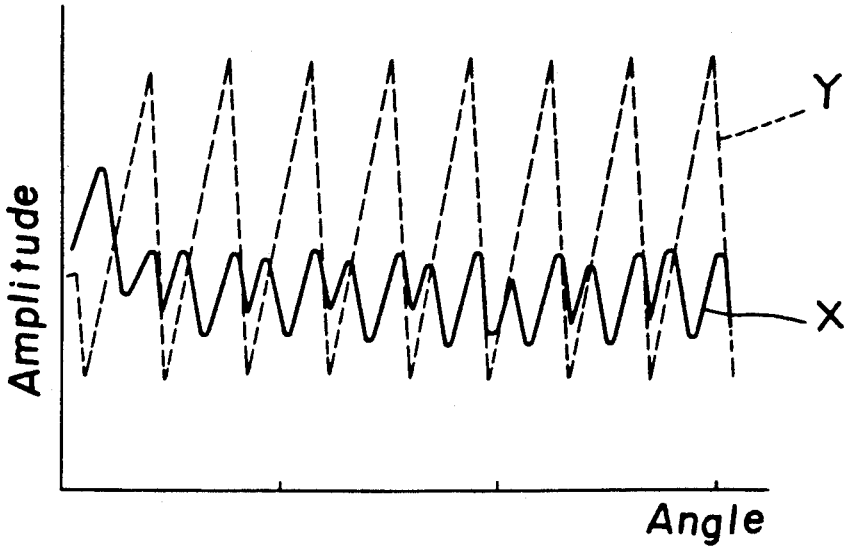
FIG. 4 is a graph showing a characteristic of an exciting force applied to a swash plate.

In FIG. 4, the axis of ordinate takes amplitude and the axis of abscissa takes an angle of rotation (one rotation) of the cylinder block 3, the characteristic of exciting force applied to the swash plate 6 is shown, and the solid line X shows that of the present invention and the dotted line Y shows that of the conventional example in comparison therewith.

Also, in FIG. 4, both the examples use eight pistons, in which the freqency of amplitude in the conventional example corresponding to the number of pistons so that it is clarified that the amplitude of vibration generated, when the eight pistons once rotate, is about four times as large as the present invention. Accordingly, although the exciting force at the conventional example is larger to that extent, it is small in the present invention to thereby effectively reduce variation in the inclined moment. In addition, the characteristic of the exciting force in the present invention shown by the solid line in FIG. 4 is of course adjustable to be a maximum value by changing the timing of communication with the first and second compensating ports 53 and 54 and the dimensional data.

Figure 5:
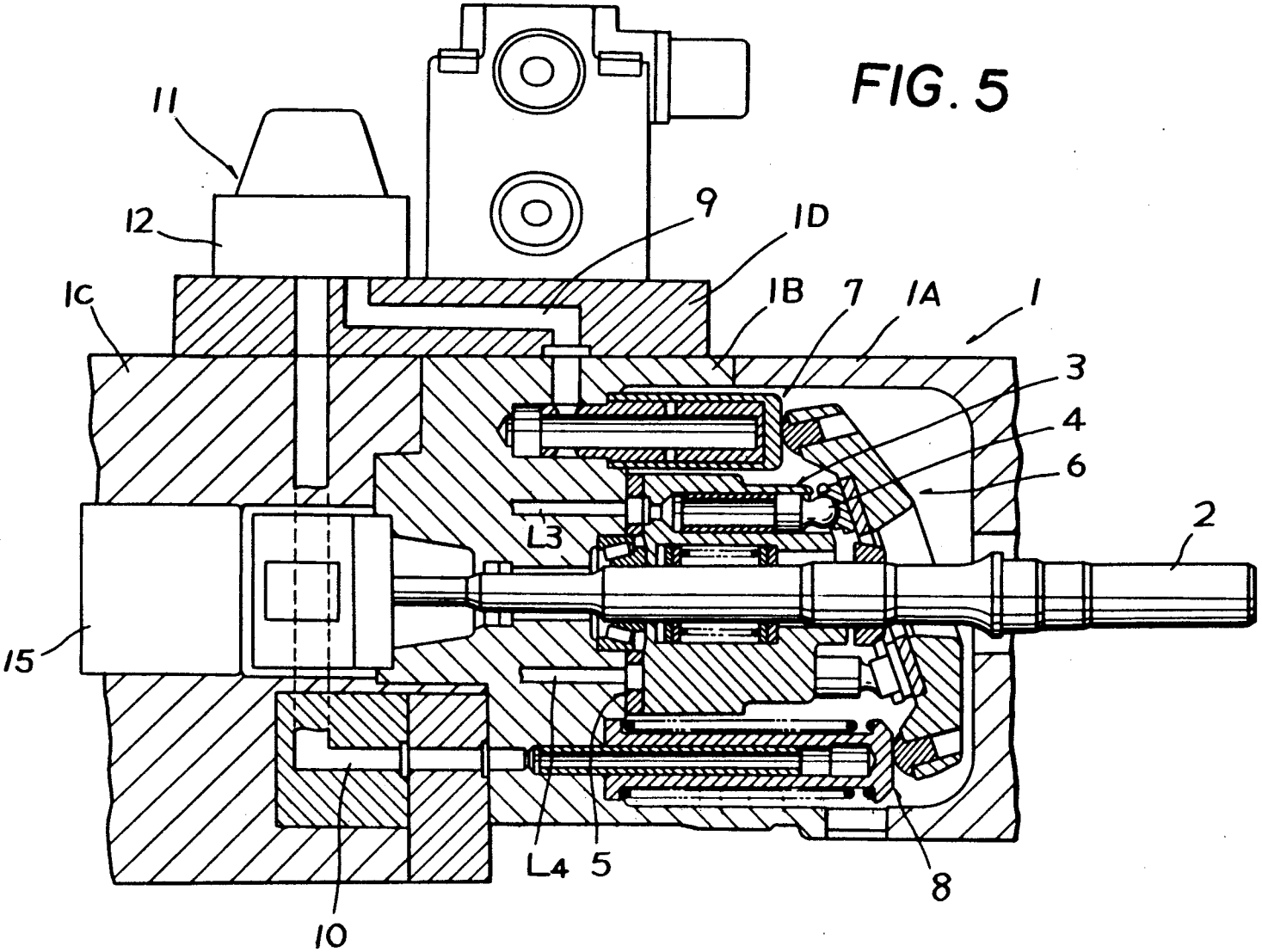
FIG. 5 is a sectional view of a second embodiment of an axial piston machine of the invention.
Figure 6:
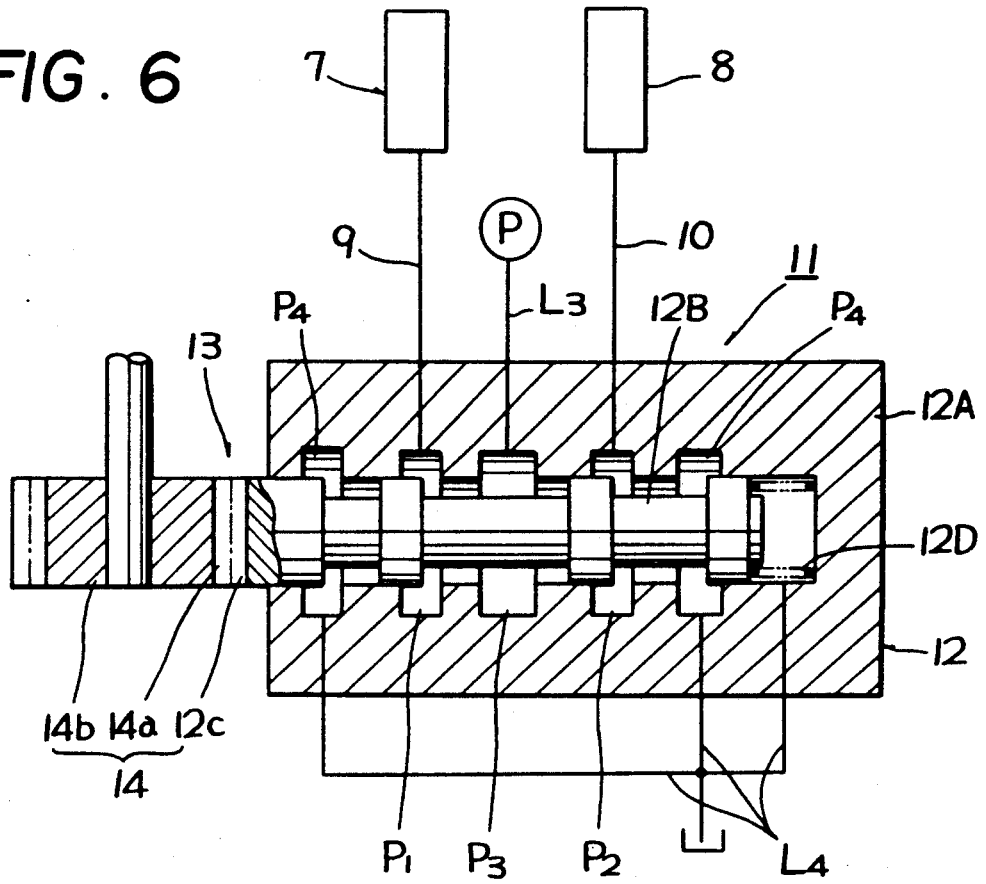
FIG. 6 is an enlarged sectional view exemplary of pressure control means at the second embodiment in FIG. 5.

Also, the above-mentioned embodiment is provided at the valve member 5 with the first and second compensating ports 53 and 54 as the pressure control means so as to utilize pressure in the cylinder piston chamber 41, which may alternatively be constructed as a second embodiment shown in FIGS. 5 and 6.

The second embodiment shown in the same drawings is provided at the first and second control pressure passages 9 and 10 connected to the first and second compensating pistons 7 and 8 with a directonal control valve 12 for reversibly changing over the control pressure passages 9 and 10 to a pressure line $L_3$ and tank lines $L_4$ respectively, which valve is used as pressure control means for introducing control presure to the first and second compensating pistons 7 and 8, the directional control valve 12 being used to change over the lines in synchronism with the rotation of driving shaft 2 for driving the cylinder block 3.

In FIG. 5, a pump housing 1 is provided which is provided with a housing body 1A and second blocks 1B and 1C disposed at the open side of the body 1A, a manifold 1D is mounted on the first and second blocks 1B and 1C, first and second control pressure passages 9 and 10 communicating with the first and second compensating pistons 7 and 8 are formed at the manifold 1D and first and scond blocks 1B and 1C respectively, and the directional control valve 12 is mounted to the manifold 1D.

The directioal control valve 12, as shown in FIG. 6, is so constructed that into a valve housing 12A provided with changeover ports $P_1$ and $P_2$ connected to the first and second control pressure passages 9 and 10 respectively and a pressure port $P_3$ and tank ports $P_4$ connected to a line $L_3$ and tank lines $L_4$ respectively, a spool 12B for reversibly changing over the changeover ports $P_1$ and $P_2$ to the pressure port $P_3$ and tank ports $P_4$ is movably housed. Synchronizing means for synchronizing the changeover operation of directional control valve 12 with the driving shaft 2, as shown in FIG. 6, mainly uses a cam mechanism 14. The cam mechanism 14 is so constructed that at one side of the valve housing 12A is disposed a cam body **14*b* rotatable in association with driving shaft 2 and having at the outer periphery a cam face 14*a*, at one lengthwise side of spool 12B housed in the valve housing 12A is provided an association portion 12C projecting therefrom and opposite to the cam face 14*a*, the associaton portion 12C is brought into elastic contact therewith by a spring 12D provided at the other lengthwise side of spool 12B, and the cam body 14*b* rotates to move the spool 12B** in reciprocation.

In the above-mentioned construction, when the cam body **14*b* rotatable in association with the driving shaft 2 rotates and one piston cylinder chamber 41 transfers from the discharge port 52 to the suction port 51 and another piston cylinder chamber 41 positioned symmetrically with respect to the one piston cylinder chamber 41 transfers from the suction port 51 to the discharge port 52, the spool 12B operates in synchronism in such a manner that the first control pressure passage 9 communicating with the first compensating piston 7 communicates with the pressure line $L_3$ and the second control pressure passage 10 communicating with the second compensating piston 8 communicates with the tank lines $L_4$. Accordingly, even though an abrupt pressure drop in the piston cylinder chamber 41 communicating with the suction port 51 in the vicinity of the upper dead point and an abrupt pressure rise in the chamber 41 communicating with the discharge port 52 in the vicinity of the lower dead point are generated, the biasing forces of the first and second compensating pistons 7 and 8 with respect to the swash plate 6 caused by the control pressure acting thereon compensates the swash plate 6 not to slantwise move. Hence, a large variation in the inclined moment is not generated at the swash plate 6** and an apparent excitng force with respect thereto is reduced as the same as the first embodiment, thereby restraining generation of vibrations and noises.

Figure 7:
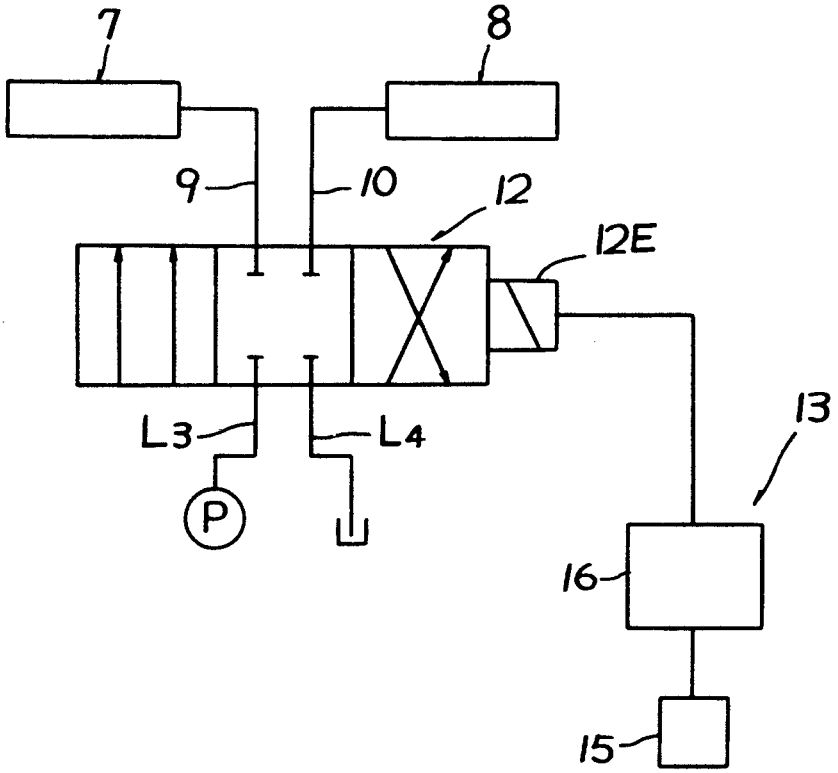
FIG. 7 is a block diagram exemplary of synchronizing means at the same.

Alternatively, the synchronizing means 13 may be constructed in such a manner that, as shown in FIG. 7, the directional control valve 12 is provided with an electromotive part 12E, such as a solenoid, and a rotation detector 15, such as an encoder, for detecting the number of rotations of the driving shaft 2 and a control unit 16 for outputting a changeover command signal in synchronism with the rotation of driving shaft 2 to the electromotive part 12E at the directional control valve 12 by use of a signal from the detector 15, are used to change over, through the electromotive part 12E, the directional control valve 12 by the changeover command signal from the control unit 16 and based on the detection result of the rotation detector 15, so that the control pressure passages 9 and 10 may selectively communicate with the pressure line $L_3$ and tank lines $L_4$ to control the control pressure applied to the first and second compensating pistons 7 and 8.

As seen from the above, in the axial piston machine of the present invention, the first and second compensating pistons 7 and 8 opposite to the swash plate 6 are disposed on the housing side and at the symmetrical positions including the upper and lower dead points of each piston 4 with respect to the swash plate 6, and the first and second control pressure passages 9 and 10 are connected to the first and second compensating pistons 7 and 8 respectively, so that the control pressure at the pressurized side is introduced to the second compensating piston 8 at the lower dead point side through the second control pressure passage 10 when the piston 4 is positioned in the vicinity of the upper dead point, and that at the pressure-reduction side is introduced to the first compensating piston 7 at the upper dead point side, the first control pressure passage 9 when the piston 4 is positioned in the vicinity of the lower dead point. Hence, even though abrupt change in the pressure within the piston cylinder chamber 41, when the pistons 4 transfer alternatively to the low pressure side and the high pressure side through the first and second compensating pistons 7 and 8, are generated simultaneously at the upper and lower dead points, simultaneously with the above, the first and second compensating pistons 7 and 8 operate to restrain the influence of pressure change. Thus, generation of a large variation in the inclined moment can be avoided at the swash plate 6 to effctively reduce the apparent exciting force with respect to the swash plate 6 and thus the whole pump and effectively restrain generation of vibrations and noises.

The first and second compensating ports 53 and 54 communicating with the piston cylinder chambers 41 are provided on the moving path thereof at the valve member 5 and at an intermediate portion between the discharge port 52 and the suction port 51, the first compensating port 53 open at upper dead point side being communicated with the second compensating portion 8 disposed at the lower dead point side and the second compensating port 54 open at the lower dead point side being communicated with the first compensating piston 7 disposed at the upper dead point side, through the control pressure passages 9 and 10 respectively, so that, when the piston cylinder chambers are positioned in the vicinities of the upper and lower dead points, pressure in the piston cylinder chambers 41, in synchronism with the rotation of cylinder block 3, is introduced to the first and second compensating pistons 7 and 8, thereby restraining a large variation in the inclined moment of the swash plate 6 caused by an abrupt pressure change. Hence, the apparent exciting force to the swash plate 6 is reducible by a simple construction. Also, when the directional control valve 12 is used as the pressure control means so as to change over the first and second control pressure passages 9 and 10 to the pressure line or the tank lines, the synchronizing means 13 is used so that the large variation in the inclined moment caused by the abrupt pressure change in the piston cylinder chamber 41 can be restrained.

Anyway, according to the invention, the first and second compensating pistons 7 and 8 provided for reducing the exciting force generated at the swash plate 6 and thus the pump enables vibrations and noises at the pump to effectively be reduced, in spite of the pressure at the load side, the flow rate of fluid, or the number of rotations of cylinder block 3.

Although several embodiments have been described, there are merely exemplary of the invention and not to be constructed as limiting, the invention being defined solely by the appended claims.

What is claimed is:

1. An improvement in an axial piston machine provided with a housing, an even number of piston cylinder chambers rotatably supported to said housing and disposed concentrically with respect to the axis of rotation, a cylinder block provided with an even number of pistons housed in said piston cylinder chambers in relation of being movable in reciprocation respectively, a driving shaft for driving said cylinder block, a swash plate for controlling a stroke of reciprocal movement of each of said pistons, and a valve member having the suction port and a discharge port communicating with said piston cylinder chambers respectively, comprising:

(a) first and second compensating pistons located opposite to said swash plate and disposed on said housing at the positions radially outward of said cylinder block and at the symmetrical positions in the vicinity of the upper dead point inclusive where said piston cylinder chamber transfers from said discharge port to said suction port and in the vicinity of the lower dead point inclusive where said piston cylinder chamber transfers from said suction port to discharge port; and (b) control means for introducing control pressure to said first and second compensating piston, said control means being provided with a first control passage connected to the rear side of said first compensating piston and a second control pressure passage connected to the rear side of said second compensating piston, so that, when said piston cylinder chamber is positioned in the vicinity of said upper dead point, control pressure at the pressurized side is introduced to said second compensating piston through said second control pressure passage and, when said piston cylinder chamber is positioned in the vicinity of said lower dead point, control pressure at the pressure-reduction side is introduced to said first compensating piston through said first control pressure passage.

2. An axial piston machine according to claim 1, wherein said valve member is provided on a moving path thereat for said piston cylinder chamber and in the vicinity of said upper dead point with a first compensating port and on said moving path and in the vicinity of said lower dead point with a second compensating port, said first compensating port being communicated with said second compensating piston through said control pressure passage and said second compensating port communicated with said first compensating piston through said first control pressure passage.

3. An axial piston machine according to claim 2, wherein each of said piston cylinder chambers at said cylinder block is provided with a connection port communicating with said suction or discharge port and a notch extending from said connection port forwardly in the rotation direction of said cylinder block.

4. An axial piston machine according to claim 1, which is provided with a pressure line communicating with said discharge port and tank lines communicating with said suction port and wherein said pressure control means is provided with; a directional control valve having changeover ports for connecting said first and second control pressure passages and a pressure port for connecting said pressure line and tank ports for connecting said tank lines so as to reversibly change over each of said changeover ports to said pressure port and tank ports; and synchronizing means for synchronizing changeover of said control valve with rotation of said driving shaft for driving said cylinder block.

5. An axial piston machine according to claim 4, wherein said synchronizing means is provided with a cam mechanism in association with said driving shaft to operate said diretional control valve for changeover.

6. An axial piston machine according to claim 4, wherein said directional control valve is provided with an electromotive part electrically changing over said directional control valve and said synchronizing means is provided with a rotation number detector for detecting the number of rotations of said driving shaft and a control device for outputting by a signal from said detector a changeover command signal in synchronism with rotation of said driving shaft to said electromotive part at said directional control valve.

* * * * *